United States Patent [19]

Tibussek

[11] 4,279,315

[45] Jul. 21, 1981

[54] APPARATUS FOR EXTRACTING CORES

[75] Inventor: Fritz Tibussek, Mönchen-Gladbach, Fed. Rep. of Germany

[73] Assignee: Wirth Maschinen- und Bohrgerate-Fabrik GmbH, Fed. Rep. of Germany

[21] Appl. No.: 117,292

[22] Filed: Jan. 31, 1980

[30] Foreign Application Priority Data

Feb. 2, 1979 [DE] Fed. Rep. of Germany ..... 2903936

[51] Int. Cl.[3] ..... E21B 10/02

[52] U.S. Cl. ..... 175/249; 175/298

[58] Field of Search ..... 175/246, 248, 249, 298, 175/299; 173/94–97

[56] References Cited

U.S. PATENT DOCUMENTS

| | | | |
|---|---|---|---|
| 2,120,240 | 6/1938 | Chappel | 175/299 |
| 2,623,733 | 12/1952 | Sewell | 175/248 |

*Primary Examiner*—William F. Pate, III

*Attorney, Agent, or Firm*—Holman & Stern

[57] ABSTRACT

An apparatus for extracting cores comprises an outer tube, an inner tube which contains a core receiving space, and a striking device which comprises a hammer and an anvil for producing a periodic axial movement of the inner tube relative to the outer tube, wherein the inner tube, the striking device and an associated supporting body form a unit which may be moved through the outer tube in the axial direction thereof by means of a withdrawal mechanism, and wherein a part of this unit joined to an element of the striking device for rotational entrainment may be connected to the inner tube.

17 Claims, 4 Drawing Figures

APPARATUS FOR EXTRACTING CORES

BACKGROUND OF THE INVENTION

1. Field of the Invention

The present invention relates to an apparatus for extracting cores, in particular apparatus comprising an outer tube which may be joined to a set of bore rods or is formed by a part thereof and which may be fitted or provided at its lower end with a core bit or the like, an inner tube which may be fitted or provided at its lower end with a core bit or the like and contains a core receiving space, and a striking device which may be driven by rotation of the outer tube and which comprises a hammer and an anvil for producing a periodic axial movement of the inner tube relative to the outer tube.

Using such an apparatus, it is possible to extract cores or appropriate samples which give useful results, even under unfavourable conditions, for example in the case of soft or varying formations.

2. Description of the Prior Art

German Offenlegungsschrift No. 1 634 490 describes apparatus which has a thread at its upper end, and by means of this thread it may be screwed into the lowermost rod of a set of bore rods. When extracting a core the whole set of rods must be drawn out in order to be able to remove, at the surface, the core from the apparatus attached to the lower end of the rods. This is complicated and time-consuming.

SUMMARY OF THE INVENTION

It is an object of the present invention to overcome existing disadvantages and shortcomings of the prior art and to provide apparatus of the type mentioned above by means of which cores may be extracted by a striking action and then removed from the apparatus without it being necessary to withdraw the drilling shaft. It should be possible, despite this, to drive the striking device by a rotational movement transmitted from above into the drilling shaft.

The present invention provides an apparatus for extracting cores which comprises an outer tube, an inner tube which contains a core receiving space, and a striking device which comprises a hammer and an anvil for producing a periodic axial movement of the inner tube relative to the outer tube. The inner tube of the apparatus, the striking device thereof and an associated supporting body form a unit which may be moved through the outer tube in the axial direction thereof by means of a withdrawal mechanism, and a part of the unit joined to an element of the striking device for rotational entrainment may be connected to the outer tube.

An apparatus of this type allows cores to be extracted in an advantageous manner at any time during the striking action, it being possible to bring up the core extracted, together with the unit containing it, and to remove it, without having to withdraw the drilling shaft itself and dismantle the set of bore rods.

DETAILED DESCRIPTION OF THE DRAWINGS

DESCRIPTION OF THE PREFERRED EMBODIMENT

Figure 1:
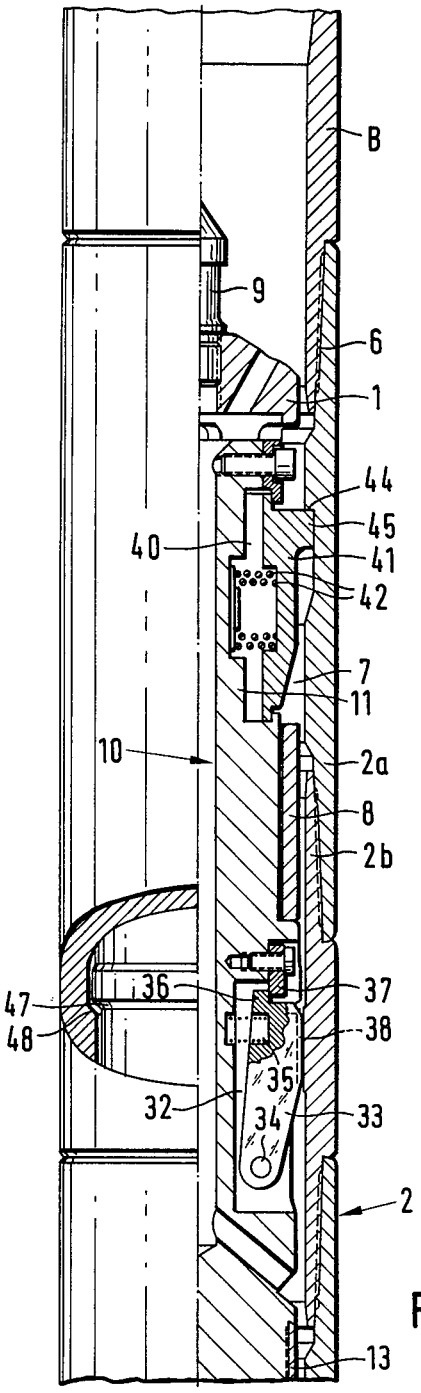
FIGS. 1 to 3 are longitudinal sectional views of the upper part, the middle part and the lower part respectively of an apparatus according to the invention.

The apparatus shown in the drawings includes an outer tube 2, which may be joined to a bore rod tube B by means of a thread 6 or by any other appropriate means, and which consists of a plurality of parts 2*a*, 2*b*, 2*c* screwed into one another and has a core bit 3 at its lower end. Inside the outer tube 2 there is a unit 10 which may be connected to the outer tube 2 both in the axial direction and for rotational entrainment and which contains a supporting body 11, a striking device 12 and an inner tube 4. An exchangeable core bit 5 is disposed at the lower end of the inner tube 4. The core bit or the inner tube may also be provided with other elements suitable for extracting cores (e.g. core catchers or core springs). The inner tube 4 includes a receiving space for the core which is to be extracted. A head member 1, which may be moved relative to the supporting body 11 and which includes a sleeve portion 8 with openings 7 provided therein and a catching stud 9, is disposed at the upper end of the supporting body 11. A catching device F attached to the end of a cable or another withdrawal means may engage on the catching stud in a known manner, so that by means of this catching device it is possible to move the head member 1 relative to the supporting body 11 and to move the entire unit 10 up and down in the axial direction through the outer tube 2 and the bore rod B in the state shown in FIG. 4. One of three hooked catching arms F of the catching device is shown in dash-dot lines in FIG. 4. The catching device may be of other known design, provided it fulfils the function indicated, i.e. it is designed in such a way that it may be connected to and disconnected from the catching stud 9 inside the bore rod.

A hammer 16 of the striking device 12 provided with ridges 15 is guided so as to be rotationally rigid but axially movable in corresponding grooves 14 of a sleeve-shaped extension 13 associated with the supporting body 11 and joined thereto. The upper face of the hammer 16 bears against a set of cup springs 17 which rests by way of spacer rings or directly against an offset portion 19 of the supporting body 11. The path of the hammer 16 towards the supporting body 11 is limited by a shoulder 20 on the inside of the hammer 16 and a bearing surface 21 on the supporting body 11. An anvil 22, which rests on a shoulder of an insert piece 23 and is prevented from rotating relative to the latter, is disposed beneath the hammer 16. As shown in broken lines in FIG. 2 at the position in question in the manner of a plan view, the anvil 22 has to this end an opening of hexagonal cross-section for example, which matches an hexagonal extension 24 of the insert piece 23. The underside of the hammer 16 has projections 26, with which there are associated an equal number of raised portions 25 on the anvil 22, which have surfaces rising on one side to form an inclined plane and dropping vertically to one edge to form a recess in each case. The arrangement is such that, when the hammer 16 is rotated about the median axis of the apparatus, strokes are delivered on the anvil 22 with a frequency which is determined by the speed of rotation per minute and the number of projections 26 and raised portions 25 with the associated recesses. The number of strokes per revolution may be in the region of three to six for example. The sleeve-shaped extension 13 of the supporting body 11 provided with the grooves 14 transmits the rotation of the bore rod B to the hammer 16.

A closure member 27 with a sealing means 28 is secured to the lower end of the sleeve-shaped extension 13, and the seals may slide over the cylindrical outer surface of the insert pieces 23. A transition member 29, to which the inner tube 4 is secured, is screwed onto the lower end of the insert piece 23. A compensation ring 30 is also provided. The transition member 29 contains a valve 31 through which bore fluid, which has been forced into the space of the inner tube 4 on entry of the core, may escape into the annular space between the unit 10 and the outer tube 2.

In order optionally to connect the supporting body 11 to the outer tube 2, connecting elements may be provided which effect both a connection in the direction of rotation and a fastening in the axial direction. In the case of the embodiment illustrated, however, separate connecting elements are present for the two functions.

Clutch dogs 33, in the form of levers pivotable about an axis 34 in each case (FIG. 1), are provided in recesses 32 in the supporting body 11 at several, for example three, positions distributed over the periphery thereof. These levers are acted upon by a compression spring 35 and are provided with a nose 36 which can bear against a stop 37, so as to determine the maximum outward position of the clutch dogs 33. The outside of the clutch dogs are formed as ridges, so that they can engage in grooves 38 of matching shape which are formed in the middle part **2*b* of the outer tube 2. In this way the supporting body 11 and the parts connected thereto, including the hammer 16, are set in rotation when the outer tube 2 is rotated by way of the bore rod B. The inside diameter of the outer tube 2 in the area above the grooves 38 and the inside diameter of the attached bore rod are greater than the maximum overall dimension of the clutch dogs 33** in their maximum outward position.

In addition, radially displaceable locking members 41, which are acted upon by compression springs 42, are provided in recesses 40 in the supporting body 11 at several positions, for example two diametrically opposite one another. A recess 43 with a circular shoulder 44 is provided on the inside of the outer tube 2. Projections 45 on the locking members 41 can bear against the shoulder 44 when the locking members 41 are in the thrust out position so that the entire unit 10 is prevented from moving axially upwards and is connected to the outer tube. This active position of the locking members 41 is illustrated in FIG. 1.

Figure 4:
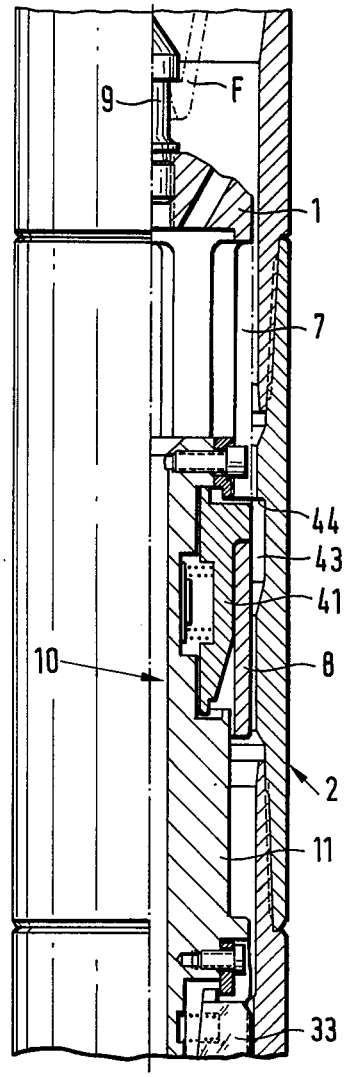
FIG. 4 is a longitudinal sectional view of the upper part of the apparatus in the detached state.

The locking members 41 may be moved from their active position to an inner rest position as shown in FIG. 4, where they are entirely inside the internal diameter of the outer tube 2 and the attached bore rod.

In the embodiment illustrated, the locking members 41 are moved inwards into the rest position by means of a slide connected to or integral with the head member; in the illustrated embodiment the slide is formed by the lower part of the sleeve portion 8 of the head member 1.

In FIG. 1 the position of the connecting elements 33 and 41 is shown which the latter occupy when the apparatus is inserted, i.e. the extracting core during boring. The rotation of the bore rod B is transmitted by way of the driving connection obtained by the clutch dogs 33 to the supporting body 11 with the sleeve-like extension 13 and from the latter to the hammer 16, so that a striking movement is imparted to the inner tube 4 with its core bit 5 working into the bottom of the core without rotation. During the boring, core fluid may pass through the ducts and annular spaces shown in the drawing to reach the core bit 5, where it flows to the outside.

When a core has been extracted, the entire unit 10 comprising the supporting body 11, the striking device 12 and the inner tube 4 is raised by means of the catching device F suspended on a cable and engaging the catching stud 9 on the head member 1, the head member 1 with its sleeve portion 8 first being moved relative to the supporting body 11 and thereby bringing the locking members 41 into the rest position shown in FIG. 4. After this, the head member 1 moves upwards together with the entire unit 10 through the bore rod, so that the core extracted may eventually be removed on the surface, while the bore rod B remains in the borehole with the outer tube 2.

After the core has been removed, the unit 10 may be lowered again any time it is desired on the catching device through the bore rod by means of the withdrawal mechanism, the clutch dogs 33 engaging in the grooves in the outer tube 2, and, in addition, after the head member 1 has been lowered further the locking members 41 are released by the sleeve portion 8 forming the slide, so that they engage under the shoulder 44 on the outer tube 2, and the connected state shown in FIG. 1 is again obtained. The supporting body 11 is provided with a collar 47, while a shoulder 48 is formed on the part **2*b* of the outer tube, so that when the unit 10 is lowered into the outer tube 2 there is a limit to its downward movement. If, in the case of the procedure described, the clutch dogs 33 do not come to rest opposite the grooves 38 in the outer tube 2, but are located in the intermediate areas, they can yield in the inward direction by the action of the springs 35. They then, however, engage in the grooves as soon as the outer tube 2** begins to rotate with the bore rod in the boring process.

Figure 2:
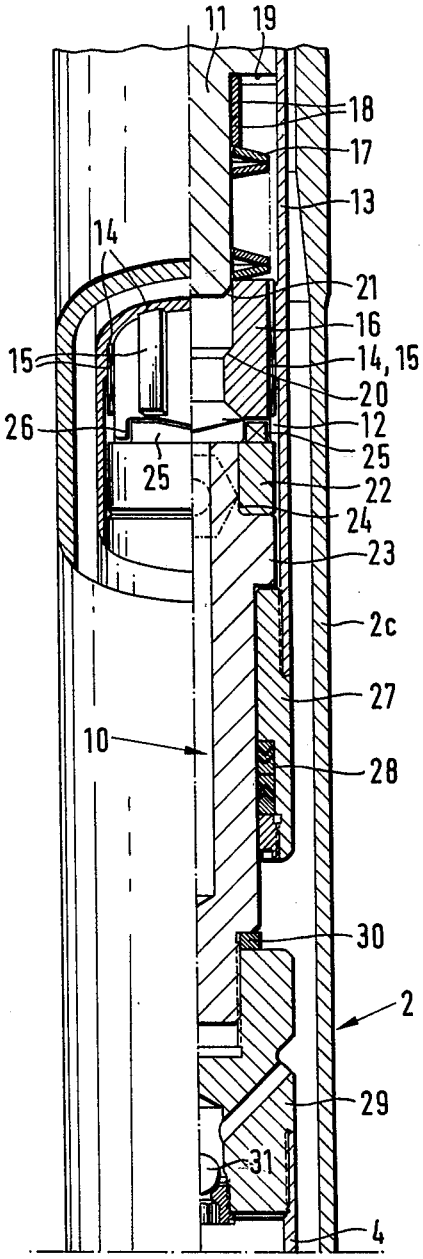
Figure 3:
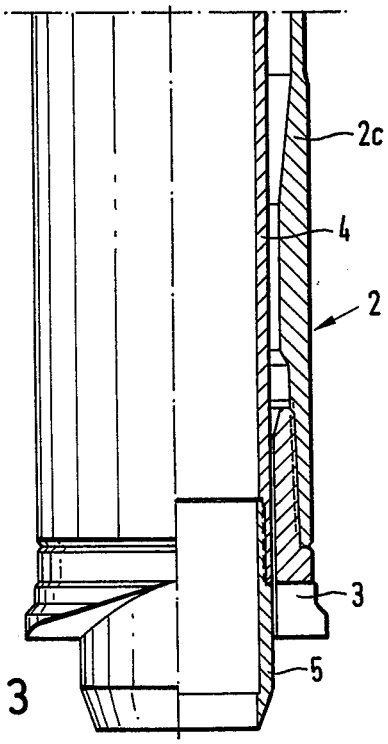

The spacer rings 18 illustrated in FIG. 2 may be selected differently in respect of their number or their length, and so be used with advantage to alter the stroke or the force of the springs 17 acting on the hammer. In this way it is possible to make advantageous adjustments to match the hammer used and/or the core bit used.

According to the circumstances the compensation ring 30 (FIG. 2) may be dispensed with, or a plurality of such rings may be provided. This provides an advantageous possibility of adjustment in order to attain the desired projection of the inner tube 4 beyond the outer tube 2 or the lead of the inner core bit 5 over the core bit 3.

Various modifications may be made within the scope of the invention.

I claim:

1. In an apparatus for extracting cores which comprises an outer tube, an inner tube which contains a core receiving space, and a striking device which comprises a hammer and an anvil for producing a periodic axial movement of the inner tube relative to the outer tube, the improvement comprising that the inner tube, the striking device and an associated supporting body form a unit which may be moved through the outer tube in the axial direction thereof by means of a withdrawl mechanism, said supporting body being provided with a sleeve-shaped extension which surrounds said striking device, and that a part of said unit joined to an element of the striking device for rotational entrainment may be connected to the inner tube.

2. The apparatus according to claim 1, wherein the hammer of the striking device is disposed so as to be rotationally rigid but axially movable within said supporting body and the sleeve-shaped extension which surrounds said striking device.

3. The apparatus according to claim 2, wherein a compression spring is provided between the hammer and an offset portion of the supporting body.

4. The apparatus according to claim 1, wherein the hammer has an inner surface and the path of the hammer in the direction of the supporting body is limited by contact of a shoulder on the inner surface of the hammer and a bearing surface provided on the supporting body.

5. The apparatus according to claim 1, wherein the sleeve-shaped extension forms a driving means for the hammer of the striking device.

6. The apparatus according to claim 1, wherein one of the sleeve-shaped extension and a member connected to said extension forms a guide for one of the inner tube and a member connected to said inner tube.

7. In an apparatus for extracting cores which comprises an outer tube, an inner tube which contains a core receiving space, and a striking device which comprises a hammer and an anvil for producing a periodic axial movement of the inner tube relative to the outer tube, the improvement comprising that the inner tube, the striking device and an associated supporting body form a unit which may be moved through the outer tube in the axial direction thereof by means of a withdrawal mechanism, said supporting body being provided thereon with separate connecting elements which serve as means for detachable rotational coupling with said outer tube and as means for detachable axial connection to said outer tube, and that a part of said unit joined to an element of the striking device for rotational entrainment may be connected to the inner tube.

8. The apparatus according to claim 7, wherein radially movable clutch dogs are provided on the supporting body and wherein the outer tube is provided with entrainment grooves to receive said clutch dogs.

9. The apparatus according to claim 8, wherein the clutch dogs are each acted upon by a compression spring.

10. The apparatus according to claim 8, further comprising stops limiting the path of the clutch dogs in the outward direction.

11. The apparatus according to claim 8, wherein the clutch dogs are in the form of pivotable levers.

12. The apparatus according to claim 8, wherein the external dimensions of the clutch dogs in their maximum outward position is less than the inside diameter of the outer tube above said entrainment grooves.

13. In an apparatus for extracting cores which comprises an outer tube, an inner tube which contains a core receiving space, and a striking device which comprises a hammer and an anvil for producing a periodic axial movement of the inner tube relative to the outer tube, the improvement comprising that the inner tube, the striking device and an associated supporting body form a unit which may be moved through the outer tube in the axial direction thereof by means of a withdrawal mechanism, said supporting body being provided thereon with radially moveable locking members and said outer tube is provided therein with a shoulder adapted for abutment against said locking members in order to secure said supporting body axially and detachably relative to said outer tube, and that a part of said unit joined to an element of the striking device for rotational entrainment may be connected to the inner tube.

14. The apparatus according to claim 13, wherein said locking members are acted upon by compression springs.

15. The apparatus according to claim 13, wherein said locking members are movable by means of a slide which is displaceable relative to the supporting body from an outer active position to an inner rest position in which the locking members are located inside the internal diameter of the outer tube.

16. The apparatus according to claim 15, wherein the slide is fixed with a head member associated with the supporting body and adapted to engage with a withdrawal mechanism.

17. The apparatus according to any one of claims 7 or 13, further comprising stops limiting the path of said unit in the downward direction.

* * * * *